United States Patent [19]

Lu et al.

[11] 3,985,663

[45] Oct. 12, 1976

[54] CONDUCTIVE INKS CONTAINING QUATERNARY AMMONIUM COMPOUNDS

[75] Inventors: Chin H. Lu, Webster; Richard A. Parent, Fairport, both of N.Y.

[73] Assignee: Xerox Corporation, Stamford, Conn.

[22] Filed: Mar. 14, 1974

[21] Appl. No.: 451,315

[52] U.S. Cl. ..... 252/62.1 L; 106/20; 106/22; 106/23; 96/1 LY

[51] Int. Cl.[2] ..... G03G 9/12

[58] Field of Search..... 252/62.1 L; 96/1 LY; 106/20, 22, 23

[56] References Cited

UNITED STATES PATENTS

| | | | |
|---|---|---|---|
| 3,084,043 | 4/1963 | Gundlach | 252/62.1 L |
| 3,720,619 | 3/1973 | Inoue et al. | 252/62.1 L |
| 3,729,418 | 4/1973 | Machida et al. | 252/62.1 L |
| 3,841,893 | 10/1974 | Honjo et al. | 252/62.1 L |

OTHER PUBLICATIONS

Research Disclosure, "Electrographic Toner and Developer Composition," Oct., 1972, p. 57.

Research Disclosure, May, 1973, pp. 64–67.

*Primary Examiner*—David Klein
*Assistant Examiner*—Judson R. Hightower
*Attorney, Agent, or Firm*—James J. Ralabate; Donald C. Kolasch; Ernest F. Chapman

[57] ABSTRACT

A method and ink composition for development of an electrostatic latent image with liquid developer is disclosed. The liquid developer has a viscosity suitable for convenient application to an imaged surface in the development of latent electrostatic images and has improved conductivity resulting from incorporating conductivity control agents in the form of quaternary ammonium compounds which are soluble in the carrier of the ink composition. The conductive ink composition comprises a coloring agent, optionally a binder and a dispersing agent, a carrier and a quaternary ammonium compound soluble in the liquid carrier.

17 Claims, No Drawings

CONDUCTIVE INKS CONTAINING QUATERNARY AMMONIUM COMPOUNDS

BACKGROUND OF THE INVENTION

This invention relates to electrostatic printing and more particularly to an improved ink or liquid developer composition for converting latent electrostatic images into visible images.

In electrostatic printing, latent electrostatic images are formed on a photoconductive surface of a recording element by uniformly charging the surface thereof, as by a corona discharge device, followed by exposure to light in the desired image pattern. Such images may be developed by solid (powder) developers or by liquid developers.

Liquid developer compositions for use with electrostatic images generally comprise a dispersion of pigment or toner particles in a volatile, insulating liquid of high volume resistivity in excess of $10^9$ ohm-centimeters. Suitable insulating liquids include: aromatic hydrocarbons, such as benzene, toluene, and xylene; aliphatic hydrocarbons, such as hexane, cyclohexane and heptane; freons and halogenated hydrocarbons and silicone oils. The liquid developer is applied to the imaged surface, and the suspended toner particles become electrostatically charged and develop the latent image by migration under influence of the image charge. This is known as electrophoretic development.

In another type of electrostatic image development disclosed by Gundlach in U.S. Pat. No. 3,084,043, liquid developers having relatively low viscosity, low volatility, contrast in color in the usual case with the surface on which it will remain, and relatively high electrical conductivity (relatively low volume resistivity), are disclosed for converting the electrostatic latent image to a visible image. According to this method, liquid developer from a reservoir is deposited on a gravure roll and fills the depressions in the roll surface. Excess developer is removed from the lands between depressions, and as a receiving surface charged in image configuration passes against the gravure roll, developer is attracted from the depressions in image configuration by the charge. This method of development is referred to as polar liquid development.

In the above described electrostatic copying devices which use liquid inks or developers wherein the developer or ink is attracted from the depressions in a gravure roll or other type of device to the surface retaining the charged image or non-image areas, there is a minimum voltage from which the ink transfers from the ink applicator (gravure roll) to the image retention surface. The minimum voltage at which ink transfers from the ink applicator to the image retention surface, such as a photoreceptor, is called the threshold voltage. In the electrostatic copying processes which use liquid inks, the electrical conductivity of the ink determines the threshold voltage as well as the degree of contrast. Inks of high electrical conductivity usually exhibit high contrast development and require low threshold voltage. Accordingly, it is advantageous to increase the conductivity of the ink compositions to lower the threshold voltage and to improve the degree of contrast. Although prior conductive ink and liquid developer compositions are known, improved results in copying processes can be obtained by increasing the conductivity of the compositions and by providing improved ink compositions.

OBJECTS OF THE INVENTION

Accordingly, it is a principal object of the present invention to provide a method and composition for development of an electrostatic latent image with a liquid developer or ink free from the inherent deficiencies and disadvantages of prior art compositions and methods.

It is an object of the present invention to produce an ink or liquid developer composition having improved electrical conductivity.

It is still another object of the present invention to provide an ink or liquid developer composition which exhibits high contrast upon development and which requires a low threshold voltage.

It is still another object of the present invention to provide a method for controlling ink or liquid developer conductivity to control thereby contrast and threshold voltage depending upon the specific application of the composition.

Another object of the present invention is to provide a process wherein the improved ink or liquid developer compositions of the present invention are applied in image configuration to a surface having a latent electrostatic image, thereon.

Still further objects and advantages of the novel ink or liquid developer composition and method of the present invention will become apparent from the following more detailed description thereof.

SUMMARY OF THE INVENTION

The above objects and others are accomplished by employing a specified class of quaternary ammonium compounds in ink or liquid developer compositions as conductivity control agents. The quaternary ammonium compounds are used to increase the conductivity, or alternatively speaking, to decrease the resistivity, of an already-conductive ink or liquid developer composition or of a non-conductive ink or liquid developer composition, for example, a liquid developer or ink having a resistivity of about $10^{10}$ ohm-centimeters. Generally, the inks or liquid developer compositions of the present invention comprise a coloring agent, a liquid carrier, optionally a binder and dispersing agent and at least one quaternary ammonium compound which is soluble in the liquid carrier. The invention lies in the discovery that when carrier-soluble quaternary ammonium compounds are used in the liquid developer compositions in an amount less than about 1 weight percent of the composition, they are effective in increasing the electrical conductivity of the ink while at the same time, they do not seriously effect other physical properties of the ink composition. The conductive liquid developer compositions of the present invention are characterized by low threshold voltage, and when they are used in a copying process for the development of electrostatic latent images, they produce copies which exhibit unusually high contrast. Furthermore, the inks or liquid developers of the present invention do not generally require any heating or drying to fix the compositions to the surface to which they are applied.

In developing electrostatic latent images on a substrate in accordance with the present invention, the conductive ink or liquid developer composition having a quaternary ammonium compound soluble in the ink carrier, is positioned close, but spaced from the electrostatic latent image on the substrate containing the latent image; flow aiding elements are provided in physical contact between the ink or developer composition and the substrate; and a bias is applied to the developer composition whereby the developer moves along the flow aiding elements and thereby develops the electrostatic latent image and becomes fixed to the substrate with little or no evaporation in the absence of heat.

DESCRIPTION OF THE PREFERRED EMBODIMENTS

The compositions of the present invention must comprise coloring agent dissolved or suspended in a liquid carrier and less than about 1.0 weight percent of a quaternary ammonium compound which is soluble in the liquid carrier. The quaternary ammonium compound is a conductivity control agent for increasing the conductivity (decreasing the resistivity) of liquid ink or developer compositions. The liquid developer or ink compositions of the present invention are characterized in that they contain at least one quaternary ammonium compound which will dissolve in the carrier of the liquid developer composition.

A preferred conductive liquid developer or ink composition of the present invention comprises up to about 20 weight percent coloring agent, less than about 1.0 weight percent of a quaternary ammonium compound and the balance, liquid carrier. When the coloring agent is a pigment which is insoluble in the liquid carrier, the ink composition may also contain up to about 10 percent of a dispersing agent to maintain the insoluble pigment in suspension.

Another preferred conductive ink composition of the present invention comprises up to about 20 percent by weight coloring agent, 0–10 percent by weight dispersing agent depending upon the type of coloring agent, less than about 1.0 percent by weight of a quaternary ammonium compound, about 5–25 percent by weight binder and the balance carrier. Optional additives, such as plasticizer, may be present in quantities up to about 40 weight percent.

In the preferred embodiments of the present invention, pigment particles are suspended in the liquid carrier and are maintained in suspension by the aid of the dispersing agent dissolved therein. A binder is also dissolved in the liquid carrier. The suspended pigment or the dissolved dye or both are employed in that amount necessary to provide the desired positive print or copy when applied to a surface. There must be a sufficient amount of dispersing agent to maintain the dispersed pigment in suspension, and there must be an amount of binder sufficient to bind the coloring agent to the substrate in those embodiments where a binder is utilized. One skilled in the art can determine a suitable amount of pigment and/or dye and dispersing agent for preparing a composition in accordance with the present invention. The concentrations of the various ingredients may be adjusted to prepare a formulation suitable as a liquid ink for use in the development of the electrostatic latent images as long as the composition remains fluid and retains a suitable conductivity.

In the composition of the type described herein, gelation of the fluid occurs when excessive amounts of the quaternary ammonium compound are dissolved in the carrier, or in certain cases, gelation occurs when the quaternary ammonium compound is insoluble in the carrier. Therefore, it is important that the amount of quaternary ammonium compound added to the composition to increase conductivity not exceed the limits which cause gelation of the ingredients in the liquid carrier. Although certain of these gels have utility in certain types of printing operations, only those which retain a fluid consistency can be utilized as liquid developers for applications to the imaged surface or its equivalent by a suitable applicator surface such as a gravure roll. One skilled in the art can adjust these parameters to provide compositions which remain fluid during storage and during the development process in the development of electrostatic latent images.

The amount of coloring agent, binder, and/or dispersing agent required to obtain the desired print or copy, or a desired viscosity within the limits of the present invention depend to a certain extent upon the particular coloring agent, binder and dispersing agent used in the liquid carrier, as well as the liquid carrier itself. The most frequently useful ranges are described above. However, in practicing the present invention, the useful inks are conductive or are inks which can be made conductive, by the process of the present invention by incorporating the quaternary ammonium compounds therein. Thus, the ink or liquid developer compositions of the present invention without the conductivity control agent may have resistivity as high as about $10^{10}$ ohm-centimeters at 25° C, and an amount of quaternary ammonium compound soluble in the carrier of less than about 1.0 percent by weight of the total composition may be used to increase the electrical conductivity, that is, reduce the resistivity, so that the ink composition is conductive in accordance with the scope of the present invention. Thus, as used herein, a conductive ink composition is an ink composition comprising the above-described ingredients and having a resistivity of about $10^9$ ohm-centimeters or less at 25° C after the quaternary ammonium conductivity control agent or agents are added to the composition. Suitable amounts of any particular ingredient for a particular liquid ink or developer can be readily determined by preparing several samples of the ink or liquid developer in question, adding different amounts of the particular ingredients to each of these samples and developing a standard electrostatic latent image with each of the so-treated samples and comparing the print quality of each to determine the amount which provides the desired results.

Pigments and dyes well-known in the art may be used in the ink or liquid developer composition. Generally, such pigments as channel carbon black, furnace carbon black and certain colored pigments are preferred in the practice of the present invention. When the coloring agent is a pigment, generally up to 20 percent by weight of the composition may comprise the pigment, a preferred range being from about 10 to 15 weight percent. In certain instances, dyes, for example, Hecto Blue R (CI Basic Violet 3, Constitution No. 42555), which are soluble in the liquid carrier, may be used in place of the pigment or in conjunction with the pigment. Very effective prints can be obtained when only about 1 percent by weight of the composition is a dye, and when a dye is used in conjunction with the pigment, the amount of pigment can be reduced by substantial amounts. One skilled in the art can easily determine the amount of dye or dye/pigment ratio to utilize the composition of the present invention. The pigments can be selected from a wide variety of solid particles and suitable organic or inorganic materials are described in the Carlson U.S. Pat. No. 2,297,691, including talcum powder, aluminum-bronze, carbon dust and the like.

The coloring agent may also be in the form of pigment particles formulated of a suitable dyestuff or carbon black embodied in a resinous carrier such as described in U.S. Pat. Nos. 2,907,674 and 2,891,911. A preferred amount of coloring agent has been set forth above and is generally about 5–20 percent by weight of the entire composition if the coloring agent is a pigment or 1 percent by weight of the composition or lower if the coloring agent is a dye. While dyes may be employed, it is generally preferred to employ pigmented inks or developers since they provide better archival permanence, covering power, are more readily immobilized at the point of deposition and provide higher density since they tend to be filtered out and remain closer to the paper surface on the final print.

As discussed above, the inks or liquid developer compositions of the present invention must be conductive, and any suitable carrier, solvent or liquid vehicle contributing to the above properties may be used. It is preferred that the carriers be inert, non-volatile, and high boiling and that they comprise about 25–90 percent (by weight) of the composition. One or more carriers in which the quaternary ammonium compounds are soluble, may be used in the composition. The carrier must be inert to the extent that it does not dissolve suspended particles, adversely react with any of the other ingredients of the ink composition, or corrode or attack any of the elements of the apparatus in which it is used or the substrate upon which it is deposited. The ink should be non-volatile to the extent that there is a minimal amount of evaporation from the composition while it is standing on the shelf or while it is being utilized in a printing or copying process or while it is being deposited upon a substrate. Thus, those organic carriers which have been found useful in the present invention and which are characterized by non-volatility, comprise those organic liquids which have boiling points of about 200° C or higher. Typical carriers within this group that may be employed singly or in combination include mineral oil, vegetable oil, such as castor oil and its oxidized derivatives, peanut oil, coconut oil, sunflower seed oil, corn oil, rape seed oil, and sesame oil. Also included are mineral spirits, fluorocarbon oils, such as duPont's Freon solvents and Krytox oils, silicone oils, kerosene, carbon tetrachloride, toluene and drying oils such as linseed oil and tung oil and highly purified polypropylene glycol. Examples of other carriers include butoxytriglycol and dibutyl phthalate. One skilled in the art can select suitable carrier for the composition of the present invention, so that the ingredients dissolved in and/or dispersed in the carrier or solvent having the quaternary ammonium conductivity control agent therein will have a resistivity of about $10^9$ ohm-centimeters at 25° C or less.

The quaternary ammonium compound, herein designated as the conductivity control agent, must be soluble in the carrier. In order to be effective in the control of the conductivity in accordance with the present invention, there must be at least about 0.05 percent by weight of the quaternary ammonium compound in the composition. The upper limit of the quaternary ammonium compound is determined by that amount which will result in the gelation of the composition. Normally, it is preferred that the amount of the quaternary ammonium compound be less than about 1.0 percent by weight of the composition. Furthermore, the upper limit of the quaternary ammonium compound may be determined by its effect on other physical properties of the composition, for example, viscosity. Usually when less than about 1 percent by weight of the quaternary ammonium compound is used in the composition, the viscosity increases only a minimal amount while the conductivity is substantially increased. This increase in conductivity may be demonstrated by the corresponding decrease in resistivity. For example, the resistivity of the ink composition without the conductivity control agent may be $10^{10}$ ohm-centimeters at 25° C and by adding less than about 1.0 percent by weight quaternary ammonium compound the resistivity of the composition is decreased to about $10^9$ ohm-centimeters at 25° C. Other examples of this decrease in resistivity or a corresponding increase in the conductivity are shown in the examples set forth below.

Quaternary ammonium compounds which are useful as conductivity controlling agents in the present invention have the general formula:

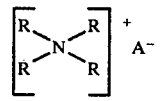

in which at least one R is a hydrocarbon having from about 1 to about 18 carbon atoms and each other R is a hydrogen or a hydrocarbon having from 1 to about 18 carbon atoms, and A is an anion, for example, sulfate, borate, chlorate, and the halogens such as iodide, chloride, and bromide. However, in practicing the present invention, only those quaternary ammonium compounds having the above-described general formula may be used in the ink compositions of the present invention if they are soluble in the liquid carrier and if they do not cause gelation of the ink composition in the effective amounts in which they are used, that is, in those amounts which reduce the conductivity of the ink composition. Thus, an effective amount of the quaternary ammonium compound of the present invention is that amount of quaternary ammonium compound which will increase the conductivity of the ink composition without adversely effecting the other properties of the composition including the viscosity and other parameters. Examples of quaternary ammonium compounds which may be used in the practice of the present invention are tetraheptyl ammonium bromide, tetrabutyl ammonium iodide and tetrabutyl ammonium bromide. To determine if a particular quaternary ammonium compound is operable in the present invention, determine if the compound is soluble in the liquid carrier. If it dissolves, then determine if the quaternary ammonium compound reduces the conductivity of a particular liquid ink or developer composition without causing the liquid composition to form a gel.

Conductivity of liquid inks is important in the field of electrostatic copying because the greater the conductivity, the lower the threshold voltage (the viscosity remaining constant) and generally the better the contrast of copies produced from the electrostatic latent image developed with the ink composition. Higher conductivity also results in a higher gamma. Gamma is the slope of the curve obtained by plotting density of the print versus voltage, the voltage being the potential difference between the photoreceptor and ground. Thus, the higher the gamma, the greater the slope. As an example of the application of this principle to the practice of the present invention, if 300 volts is applied to the photoreceptor, and the threshold voltage of the ink is not attained, there is no migration of the ink from the ink applicator to the photoreceptor and consequently no image will be developed. However, for example, if 500 volts is applied to the photoreceptor, and the same ink is used, then there will be migration of the ink composition from the ink applicator to the photoreceptor if the threshold voltage of the ink is reached, and the image will be developed. This is because the threshold voltage, that is, the minimum voltage at which ink will transfer from the ink applicator to the photoreceptor, has been reached. However, when the threshold voltage is reduced, then the voltage on the photoreceptor can be reduced or diminished with the result that migration of the ink composition will still occur across the gap between the ink applicator and the photoreceptor or image surface. The threshold voltage for the ink composition can be lowered by increasing the conductivity of the ink.

Another factor to be considered in this regard is the viscosity of the ink composition, since the migration of the ink from the ink applicator to the photoreceptor is also a function of the viscosity of the ink composition. The viscosity of the inks of the present invention are preferably from about 50 to about 1,000 centipoises at 25° C and are preferably below about 500 centipoises at 25° C. The most preferred range for the viscosity of the ink composition of the present invention is about 250–500 centipoises at 25° C. If the viscosity of the ink or liquid developer is too high, the developer cannot be utilized in the development of latent electrostatic images in view of the fact that it will fail to migrate to the charged image configuration of the image retention surface within the development time. On the other hand, if the viscosity is too low, there will be too much liquid developer on the charged image area resulting in poor print quality. One skilled in the art can manipulate the viscosity by controlling the amount and type of pigment, carrier and other ingredients in the composition including viscosity control agents.

A dispersant or dispersing agent is generally employed to aid in dispersing the pigment and other additives in the liquid carrier. Any suitable dispersing agent may be employed that is compatible with and soluble in the carrier. The amount of dispersing agent is generally based upon the amount of pigment or other particles to be dispersed in the carrier and generally comprises about 5–30 percent by weight of the pigment content. It is generally preferred that the amount of dispersing agent be about 20 percent by weight of the amount of pigment in the composition, or expressed in terms of the total composition, that the dispersing agent be present in an amount of about 1 percent by weight to about 10 percent by weight of the total composition. Generally, a dispersing agent or mixtures of dispersing agents improve the shelf-life of the composition by increasing the ability of the pigment particles and/or the dispersed resin or other additives to remain dispersed in the carrier upon standing. The amount of dispersing agent required to maintain the pigment or other additives in suspension in the carrier may be adjusted by one skilled in the art. Typical dispersing agents include polyvinyl pyrrolidone, alkylated polyvinyl pyrrolidone, alkyl phenoxy polyethoxy ethanol, lecithin mixtures, tertiary alkyl primary amines, long chain fatty acid esters containing multiple ether linkages, glyceride phosphate, and interpolymers of n-octodecyl vinyl ether and maleic anhydride such as Gantrez AN 8194 manufactured by GAF Corporation. Alkylated polymers of heterocyclic N-vinyl monomers may also be utilized as dispersants in preparing the compositions of the present invention. Examples of these and other alkylated polymers of comparable monomers are described in U.S. Pat. No. 3,542,682.

In the preferred composition of the present invention, a binder which will bind the pigment to the substrate to which it is transferred may be used. Any binder which will serve this purpose and which will not adversely interfere with the conductivity of the liquid developer, the quality of the print, the viscosity of the composition or cause the composition to gel upon standing, may be used in the practice of the present invention. Suitable binders for use in the composition of the present invention include, for example, various resins and modified resins, such as, epoxy resins, phenolic resins, polyesters and rosin esters. Certain preferred binders include modified phenolic resins, maleic rosin ester, modified rosin ester, glycerol ester of hydrogenated rosin, certain acrylic type resins, polyamide resins, and esterified wood rosin.

Other ingredients may be added to the ink or liquid developer composition of the present invention as long as such additives do not have a deleterious effect upon the conductivity, viscosity, print quality, or upon the ability of the conductivity control agent to reduce the conductivity of the ink composition. For example, certain plasticizers, such as dibutyl phthalate, di-isodecyl adipate and triethylene glycol di(2-ethylbutyrate) may be added to the ink compositions.

The developers of the present invention may be prepared by simply mixing the several constituents. The pigment may be comminuted separately or together with the carrier. The quaternary ammonium compound may also be added at any stage of the mixing of the ink composition, or it may be added at a subsequent time after the other ingredients of the ink composition have been mixed.

Although the compositions of the present invention may be utilized in any type of liquid development of the electrostatic latent images, one method for utilizing the composition of the present invention is disclosed by Gundlach in U.S. Pat. No. 3,084,043. In a method for the development of an electrostatic latent image on a substrate, the conductive liquid developer composition of the present invention which contains a quaternary ammonium conductivity control agent, may be deposited upon a gravure type roll or other suitable applicator containing "lands" and "valleys" and positioned adjacent the electrostatic latent image on the substrate. In such a method, it is preferred that the liquid developer be removed by a suitable means from the lands of the gravure roll prior to the development of the electrostatic latent image on the substrate. Following this, a bias is applied to the developer so that the developer moves along the valleys of the gravure roll in the direction of the electrostatic latent image on the substrate in image configuration. Various modifications of this method may be made by one skilled in the art within the limits of the present invention which comprises applying in image configuration to the electrostatic latent image on a photoconductive layer, a conductive ink having a resistivity at 25° C of less than about $10^9$ ohm-centimeters and a viscosity of about 50 to about 1,000 centipoises at 25° C and comprising about 0.1 to about 30 weight percent of a coloring agent capable of coloring said latent image when attracted thereto;

about 0.05 but less than about 1.0 weight percent of a quaternary ammonium compound; about 5 to about 25 weight percent of a binder; about 1 to about 10 weight percent of a dispersing agent for said coloring agent; and the balance carrier, said quaternary ammonium compound being soluble in said carrier. Up to about 40 weight percent of the ink composition can also be a plasticizer.

Any suitable applicator surface may be employed to dispense the conductive liquid developer. Typically, the applicator surfaces have substantially uniform patterns of raised portions described above as lands and the depressed portions described above as valleys with the depressed portions being sufficiently large to hold sufficient ink or liquid developer to provide adequate image density during development. However, to minimize wear on the imaging surfaces, it is preferred to provide raised portions which are uniformly curved or substantially flat on the surfaces which contact the imaging surface. Typical applicator surfaces include, for example, porous ceramics, metallic sponge, patterned webs or belts, capillary combs and cylindrical rolls having surface patterns such as single screw cuts or trihelicoid, pyramidal or quadragravure indentations. To provide good image resolution, it is preferred that the applicator surface have a pattern comprising between about 100 and 300 demarcations of raised or depressed areas per inch. Generally, with more coarse patterns, insufficient resolution is obtained and with finer patterns, insufficient loading of developer in the recessed portions is obtained to provide good image density. It is generally preferred to employ a pattern of recessed grooves such as in the trihelicoid since this pattern facilitates better doctoring of the applicator surface.

The applicator surface may be loaded with the conductive ink or liquid developer in any suitable manner. Typical liquid developer or ink loading techniques include applying developer from a roll or sponge roll or immersing the applicator in a bath. Prior to contacting the imaging surface, the applicator surface should be wiped or "doctored" clean until substantially all conductive liquid developer is removed from the raised portions of the applicator surface. Any suitable means may be provided as the doctoring device. Typical doctoring devices include scraper blades and squeegee rolls. The doctoring, in addition to removing liquid developer from the raised portions of the applicator surface, preferably provides a slight wiping action of the liquid developer in the recessed portions of the applicator surface to maintain thereby the level of the conductive liquid developer in the recessed portions slightly below the level of the raised portions. Such a loading of the conductive liquid developer on the applicator surface minimizes the deposits in the non-image areas.

Having described the basic ingredients of the composition of the present invention and a preferred method by which the composition may be used, illustration will now be made of the formulation and use of various developing compositions representative of those in the presence invention.

EXAMPLE I

A composition was prepared having the following ingredients: 12 percent by weight channel carbon black (Black Pearls A manufactured by Cabot Corp.), 6 percent by weight polyvinyl pyrrolidone dispersing agent (PVP-K15 manufactured by GAF Corp.), 15 percent by weight glycerol ester of hydrogenated rosin binder (Staybelite Ester 5 manufactured by Hercules, Inc.), and 67 percent by weight butoxytriglycol carrier. The viscosity of the ink composition was 150–190 centipoises at 25° C and had an electrical conductivity of $3 \times 10^{-8}$ mho per cm.

The same ink composition as above was prepared except that 0.25 percent by weight of tetrabutyl ammonium bromide was incorporated in the ink and the carrier comprised 66.75 percent by weight of the composition. The ink having the quaternary ammonium compound conductivity control agent had a viscosity of 160–180 centipoises at 25° C and an electrical conductivity of $2 \times 10^{-6}$ mho per cm. This improvement in electrical conductivity produced by incorporation of the quaternary ammonium compound in the ink composition represents a 50-fold increase in the electrical conductivity of the ink. The ink composition exhibited unusually high contrast development characteristics and demonstrated very low threshold voltage when utilized in the development of an electrostatic latent image.

The same ink composition as above was prepared except that 1.0 percent by weight of the tetrabutyl ammonium bromide was incorporated in the ink and the carrier comprised 66.0 percent by weight of the composition. The ink having the quaternary ammonium compound conductivity control agent had a viscosity of 323 centipoises at 25° C and a resistivity of $1.4 \times 10^5$ ohm-cm. at 25° C. However, the ink was not suitable as a liquid developer for the development of electrostatic latent images by the process of the present invention because it formed a gel on standing.

Throughout the specification and in all examples, unless otherwise stated, the amounts of the various ingredients designated in percentage, refer to percent by weight of the composition. Viscosities were determined on a Brookfield viscometer using a No. 2 Spindle rotating at 30 R.P.M., and values are given in centipoises measured at 25° C unless otherwise designated. Conductivities in mho per centimeter and resistivities in ohm-centimeter were measured by using a manually balanced AC Wheatstone bridge and a conductivity cell of 0.01 cell constant.

EXAMPLE II

A liquid developer composition having the following ingredients was prepared:

| | |
|---|---|
| Channel Carbon Black (Mogul A, Cabot Corp.) | 12.0% |
| Polyvinyl pyrrolidone (PVP-K15, GAF Corp.) dispersing agent | 6.0% |
| Binder, Glycerol Ester of Hydrogenated Rosin (Staybelite Ester 5, Hercules, Inc.) | 15.0% |
| Butoxytriglycol carrier | As shown below |

| Carrier | Tetrabutyl Ammonium Bromide | Resistivity (ohm-cm.) | Viscosity cp., 25° C |
|---|---|---|---|
| 67.0% | 0% | $1.7 \times 10^7$ | 130 |
| 66.9% | 0.1% | $1.4 \times 10^6$ | 120 |
| 66.8% | 0.2% | $7.6 \times 10^5$ | 130 |
| 66.6% | 0.4% | $3.2 \times 10^5$ | 160 |

EXAMPLE III

A liquid developer composition having the following composition was prepared:

| | |
|---|---|
| Furnace carbon black pigment (Mogul L, Cabot Corp.) | 12.0% |
| Alkylated polyvinyl pyrrolidone dispersant (Ganex V516, GAF Corp.) | 6.0% |
| Maleic rosin ester binder (Beckacite 1110, Reichhold Chemicals, Inc.) | 15.0% |
| Dibutyl phthalate carrier | As shown below |

| Carrier | Tetrabutyl Ammonium Bromide | Resistivity (ohm-cm.) | Viscosity cp., 25° C |
|---|---|---|---|
| 67.0% | 0% | $5.0 \times 10^8$ | 400 |
| 66.9% | 0.1% | $1.8 \times 10^7$ | 430 |
| 66.8% | 0.2% | $1.3 \times 10^7$ | 450 |

EXAMPLE IV

A liquid developer composition having the following composition was prepared:

| | |
|---|---|
| Furnace carbon black pigment (Mogul L, Cabot Corp.) | 17.0% |
| Polyvinyl pyrrolidone dispersing agent (PVP-K15, GAF Corp.) | 6.0% |
| Modified phenolics resin binder (Beckacite 1102, Reichhold Chemicals, Inc.) | 22.0% |
| Butoxytriglycol carrier | As shown below |

| Carrier | Tetraheptyl Ammonium Bromide | Resistivity (ohm-cm.) | Viscosity cp., 25° C |
|---|---|---|---|
| 55% | 0% | $2.2 \times 10^7$ | 420 |
| 54.9% | 0.1% | $6.2 \times 10^6$ | 440 |

EXAMPLE V

Liquid developer compositions were prepared as in Example IV except tetrabutyl ammonium iodide was used as the conductivity control agent. Amounts of carrier and tetrabutyl ammonium iodide are shown below:

| Carrier | Tetrabutyl Ammonium Iodide | Resistivity (ohm-cm.) | Viscosity cp., 25° C |
|---|---|---|---|
| 55% | 0% | $2.2 \times 10^7$ | 420 |
| 54.8% | 0.2% | $4.2 \times 10^6$ | 570 |

The above examples demonstrate the substantial increase in conductivity or decrease in resistivity according to the particular measurement designated, when the quaternary ammonium compounds are used as conductivity control agents in accordance with the objects of the present invention. By using the conductive ink compositions of the present invention, the inks exhibit high contrast development and require a low threshold voltage during development. By adding or incorporating the quaternary ammonium compounds which are soluble in the carrier in amounts which do not cause gelation of the ink composition, generally less than about 1.0 weight percent of the ink composition, the electrical conductivity of the ink composition is substantially increased.

The ink compositions prepared in the above examples had characteristics suitable for use as liquid developers in the development of latent electrostatic images. The inks are suitable for application to latent electrostatic images which have been formed on the photoconductive surface of a recording element by uniformly charging the surface thereof, as by a corona discharge device, followed by exposure to light in the desired image pattern, or for application to latent electrostatic images formed as above and transferred to other substrates. The images are then developed by the application of the conductive liquid inks or developers to the image surface for development in image configuration. The improved conductivity resulting from incorporating the specified quaternary ammonium compounds in the ink compositions of this invention, have been amply demonstrated.

It should be understood that the foregoing description is for the purpose of illustration only, and that the invention includes all modifications falling within the scope of the appended claims.

What is claimed is:

1. A conductive ink comprising a coloring agent, a liquid carrier and a quaternary ammonium compound soluble in said carrier, said quaternary ammonium compound having the formula:

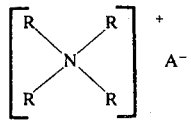

in which at least one R is a hydrocarbon having from about 1 to about 18 carbon atoms and each other R is a hydrogen or a hydrocarbon having from 1 to about 18 carbon atoms and A is an anion.

2. The ink of claim 1 wherein less than about 1.0 weight percent thereof is quaternary ammonium compound.

3. The ink of claim 1 wherein about 0.05 to about 0.5 weight percent thereof is quaternary ammonium compound.

4. The ink of claim 1 further comprising a dispersing agent and a binder.

5. The ink of claim 1 wherein the quaternary ammonium compound is selected from the group consisting of tetraheptyl ammonium bromide, tetrabutyl ammonium iodide, and tetrabutyl ammonium bromide.

6. The ink of claim 1 wherein the resistivity is less than about $10^9$ ohm-centimeters at 25° C and the viscosity is less than about 1,000 centipoises at 25° C.

7. The ink of claim 1 wherein the coloring agent is about 0.1 to about 30 weight percent thereof.

8. The ink of claim 4 wherein the binder is about 5 to about 25 weight percent thereof.

9. The ink of claim 4 wherein the dispersing agent is about 1 to about 10 weight percent thereof.

10. The ink of claim 4 further comprising up to about 40 weight percent plasticizer.

11. A conductive ink for visual development of a latent electrostatic image on a surface, said ink having a resistivity at 25° C of less than about $10^9$ ohm-centimeters and a viscosity of about 50 to about 1,000 centipoises at 25° C and comprising about 0.1 to about 30 weight percent of a coloring agent capable of yielding color copies when attracted to a latent image; about 0.05 to less than about 1.0 weight percent of a quaternary ammonium compound; about 5 to about 25 weight percent of a binder; about 1 to about 10 weight percent of a dispersing agent for said coloring agent; and the balance carrier, said quaternary ammonium compound being soluble in said carrier, said quaternary ammonium compound having the formula:

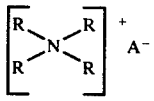

in which at least one R is a hydrocarbon having from about 1 to about 18 carbon atoms and each other R is a hydrogen or a hydrocarbon having from 1 to about 18 carbon atoms and A is an anion.

12. The ink of claim 11 wherein the carrier is about 25 to about 94.0 weight percent thereof.

13. The ink of claim 11 wherein the carrier is butoxytriglycol.

14. The ink of claim 11 wherein the carrier is dibutyl phthalate.

15. The ink of claim 11 wherein the quaternary ammonium compound soluble in said carrier is selected from the group consisting of tetraheptyl ammonium bromide, tetrabutyl ammonium iodide and tetrabutyl ammonium bromide.

16. A method of increasing the conductivity of an ink having a coloring agent, a carrier and optionally a binder and a dispersing agent, comprising incorporating therein less than about 1.0 weight percent quaternary ammonium compound soluble in said carrier, said quaternary ammonium compound having the formula:

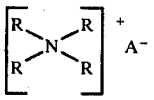

in which at least one R is a hydrocarbon having from about 1 to about 18 carbon atoms and each other R is a hydrogen or a hydrocarbon having from 1 to about 18 carbon atoms and A is an anion.

17. The method of claim 16 wherein about 0.05 to about 0.5 weight percent of quaternary ammonium compound is added to the ink of claim 16.

* * * * *